US005383798A

United States Patent [19]

Lin

[11] Patent Number: 5,383,798

[45] Date of Patent: Jan. 24, 1995

[54] VCR TERMINAL CONNECTOR

[76] Inventor: Lark Lin, No. 43-3, Pei-Tao Li, Tan-Shui Town, Taipei Hsien, Taiwan, Prov. of China

[21] Appl. No.: 106,577

[22] Filed: Aug. 16, 1993

[51] Int. Cl.[6] ..... H01R 9/07

[52] U.S. Cl. ..... 439/578; 439/840

[58] Field of Search ..... 439/736, 578–585, 439/840, 841, 675

[56] References Cited

U.S. PATENT DOCUMENTS

| | | | |
|---|---|---|---|
| 3,196,382 | 7/1985 | Morello, Jr. | 439/585 |
| 4,572,605 | 2/1986 | Hess | 439/585 |
| 4,911,660 | 3/1990 | Alf et al. | 439/585 |
| 4,995,832 | 2/1991 | Thommen et al. | 439/578 |
| 5,197,904 | 3/1993 | Gold | 439/736 |

*Primary Examiner*—David L. Pirlot

*Attorney, Agent, or Firm*—Morton J. Rosenberg; David I. Klein

[57] ABSTRACT

A VCR terminal connector which includes a metal contact casing connected to the outside conductor of a coaxial cable by punching, a shell covered around the metal contact casing, a coil spring retained to the shell around the coaxial cable, a metal contact center rod retained inside the metal contact casing by insulator bushings and connected to the central conductor of the coaxial cable by punching, and a layer of insulating shield formed through an injection molding process and covered over the metal contact casing and the central conductor and outside conductor of the coaxial cable and filled up the gaps between the metal contact center rod and the metal contact casing to protect the connector against moisture and dust.

1 Claim, 4 Drawing Sheets

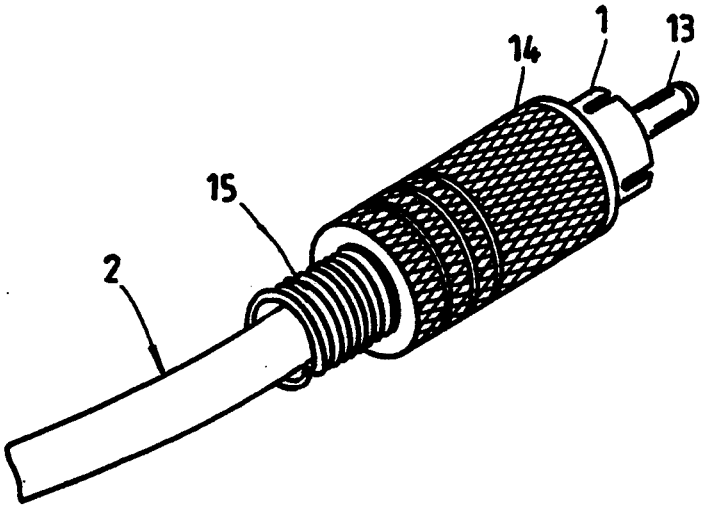
FIG. 6
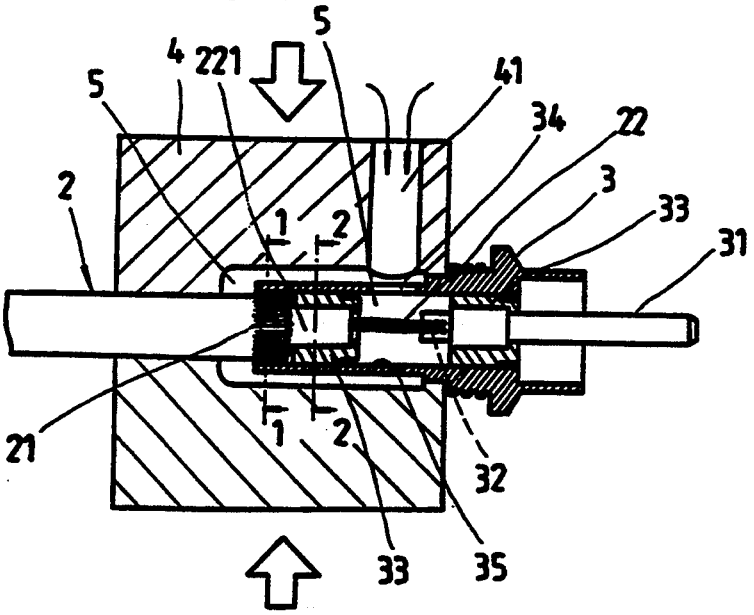
FIG. 4
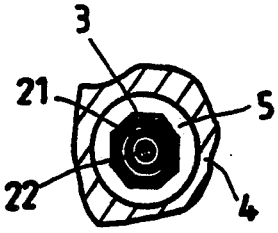
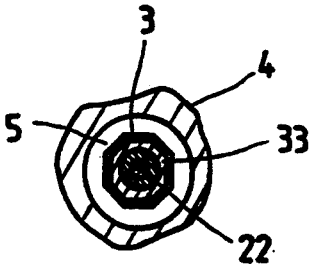
FIG. 4A FIG. 4B

VCR TERMINAL CONNECTOR

BACKGROUND OF THE INVENTION

The present invention relates to a VCR (videocassette recorder) terminal connector which has a layer of insulating shield to protect against moisture and dust.

FIGS. 1 and 2 illustrate a VCR terminal connector according to the prior art which is generally comprised of a metal contact casing covered within a shell, a coil spring retained between the metal contact casing and the shield, a metal contact center rod retained inside the metal contact casing by an insulator and connected to the central conductor of a coaxial cable, and a clamp clamped on the coaxial cable and having one end welded to the metal contact casing and an opposite end welded to the outside conductor of the coaxial cable. The drawbacks of the structure of VCR terminal connector are numerous and outlined hereinafter, 1. Because the clamp is fastened between the metal contact casing and the outside conductor of the coaxial cable through a welding process, a special technique is needed to fasten the clamp, and therefore the labor cost will be relatively increased.

2. The quality of the VCR terminal connector is difficult to control because the clamp must be welded to the metal contact casing and the outside conductor of the coaxial cable by labor.

3. The clamp may be twisted easily as the coaxial cable is stretched, causing the central conductor of the coaxial cable to disconnect from the metal contact center rod of the VCR terminal connector.

4. Moisture and dirts may penetrate into the VCR terminal connector and cover on the conductors to affect the transmission quality.

SUMMARY OF THE INVENTION

The present invention eliminates the aforesaid drawbacks. According to the present invention, the metal contact center rod is deformed by punching as the central conductor of the coaxial cable is inserted into a hole on the rear end of the metal contact center rod, and therefore the central conductor of the coaxial cable is firmly retained to the metal contact center rod. As the metal contact center rod and the coaxial cable are inserted into the axial through hole of the metal contact casing,e outside conductor of the coaxial cable is retained to the inside wall of the metal contact casing by insulating bushings, and then the metal contact casing is deformed by punching to let the coaxial cable be tightly retained in place, A layer of insulating shield is formed through an injection molding process and covered over the metal contact casing and the central conductor and outside conductor of the coaxial cable, and filled up the gaps between the metal contact center rod and the metal contact casing to protect the connector against moisture and dust.

Figure 1:
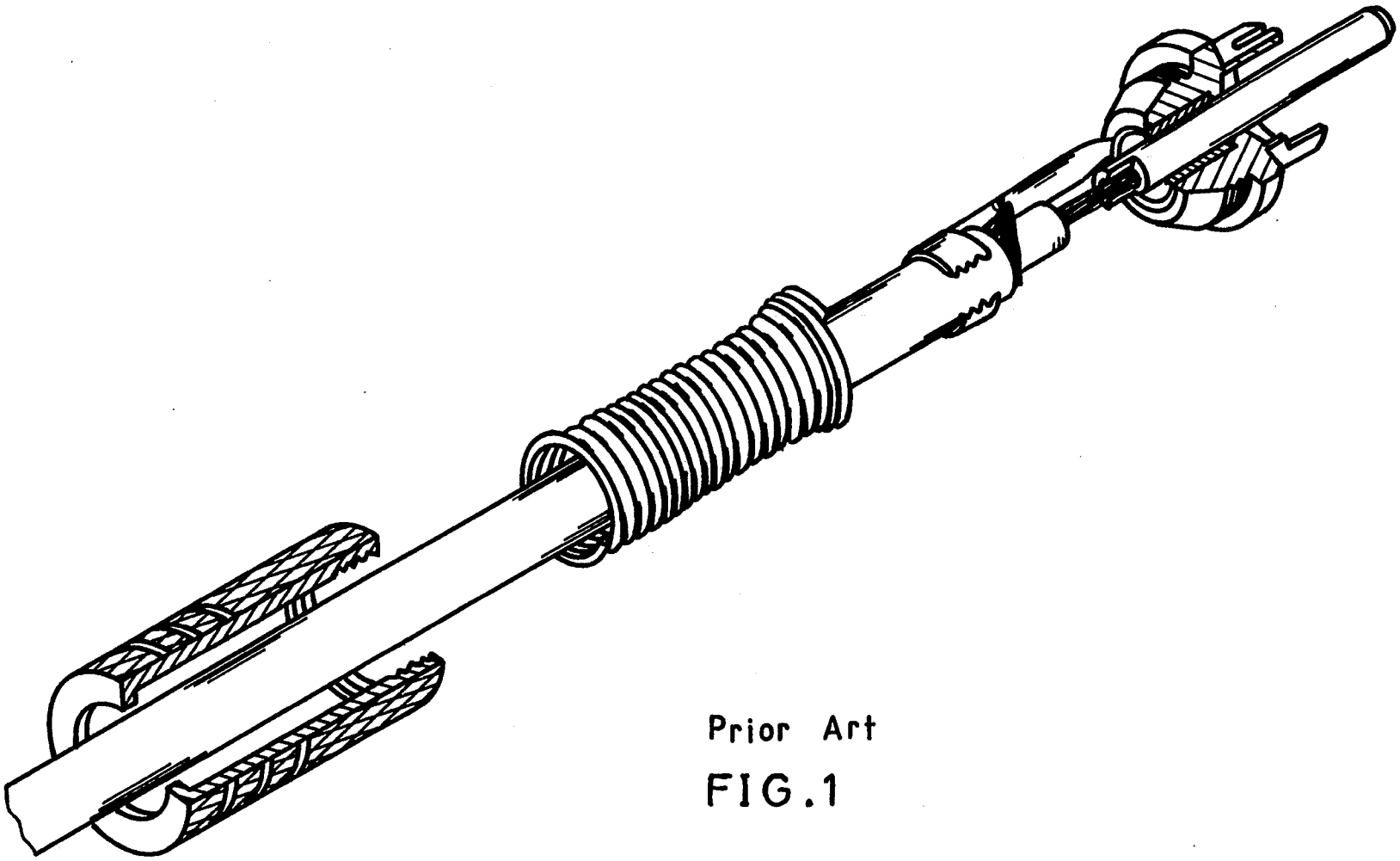
Prior Art FIG. 1
FIG. 1 is a cut away view of a prior art VCR terminal connector.
Figure 2:
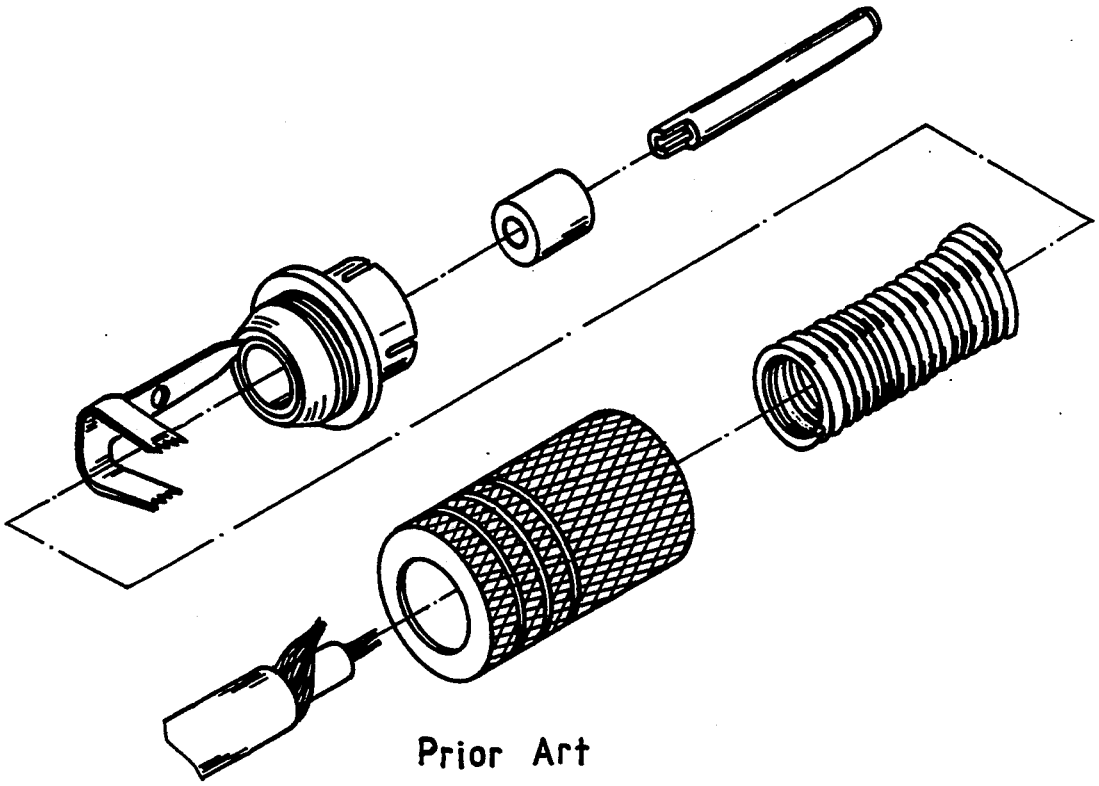
Prior Art FIG.2
Figure 5:
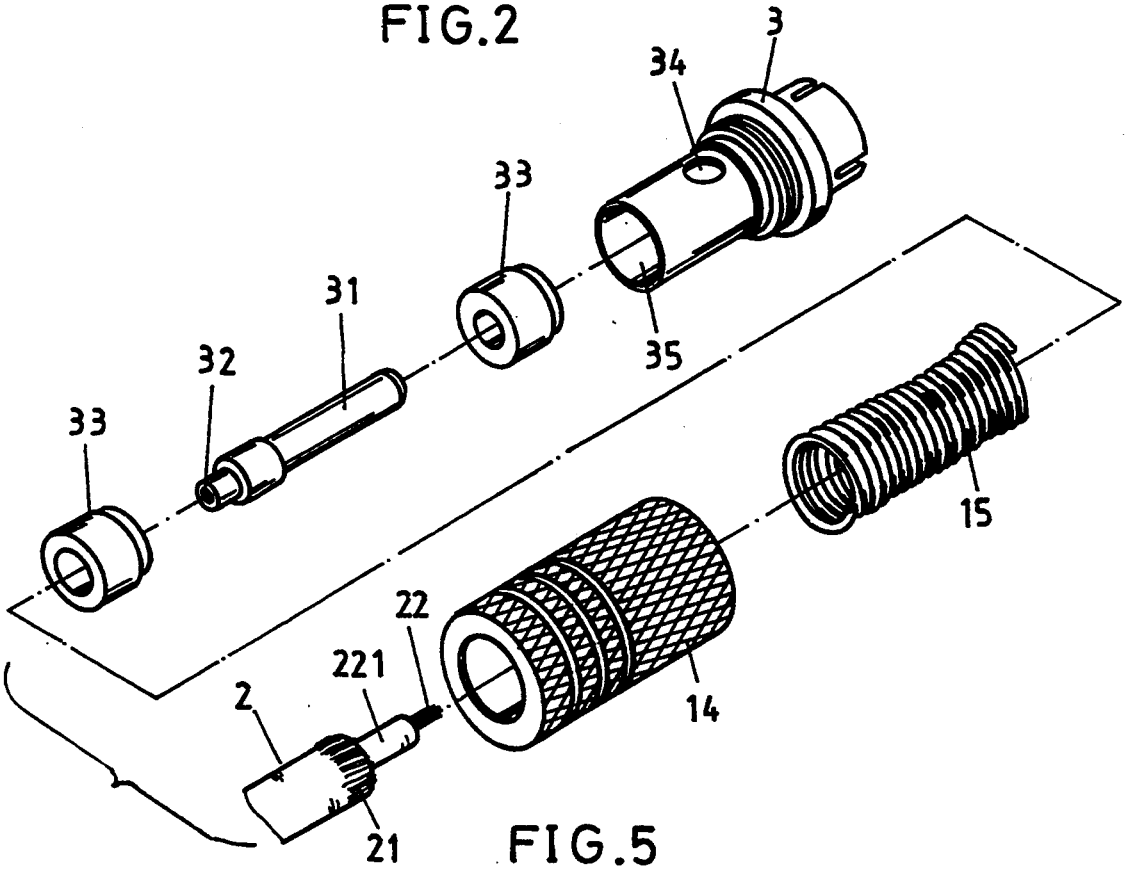

Fig, 2 is an exploded view of the prior art VCR terminal connector of FIG. 1;

Fig, 3 is a cut away view of a VCR terminal connector according to the preferred embodiment of the present invention;

FIG. 4 is a sectional view showing a liquid insulating compound filled into the mold and covered over the connection between the coaxial cable and the metal contact casing and the connection between the coaxial cable and the metal contact center rod;

Fig, 4A is a cross section taken along line 1—1 of FIG. 4;

Fig, 4B is a cross section taken along line 2-2 of FIG. 4;

FIG. 5 is an exploded view of the VCR terminal connector of the preferred embodiment of the present invention; and FIG. 6 is an elevational view of the VCR terminal connector of the preferred embodiment of the present invention.

DETAILED DESCRIPTION OF THE PREFERRED EMBODIMENT

Figure 3:
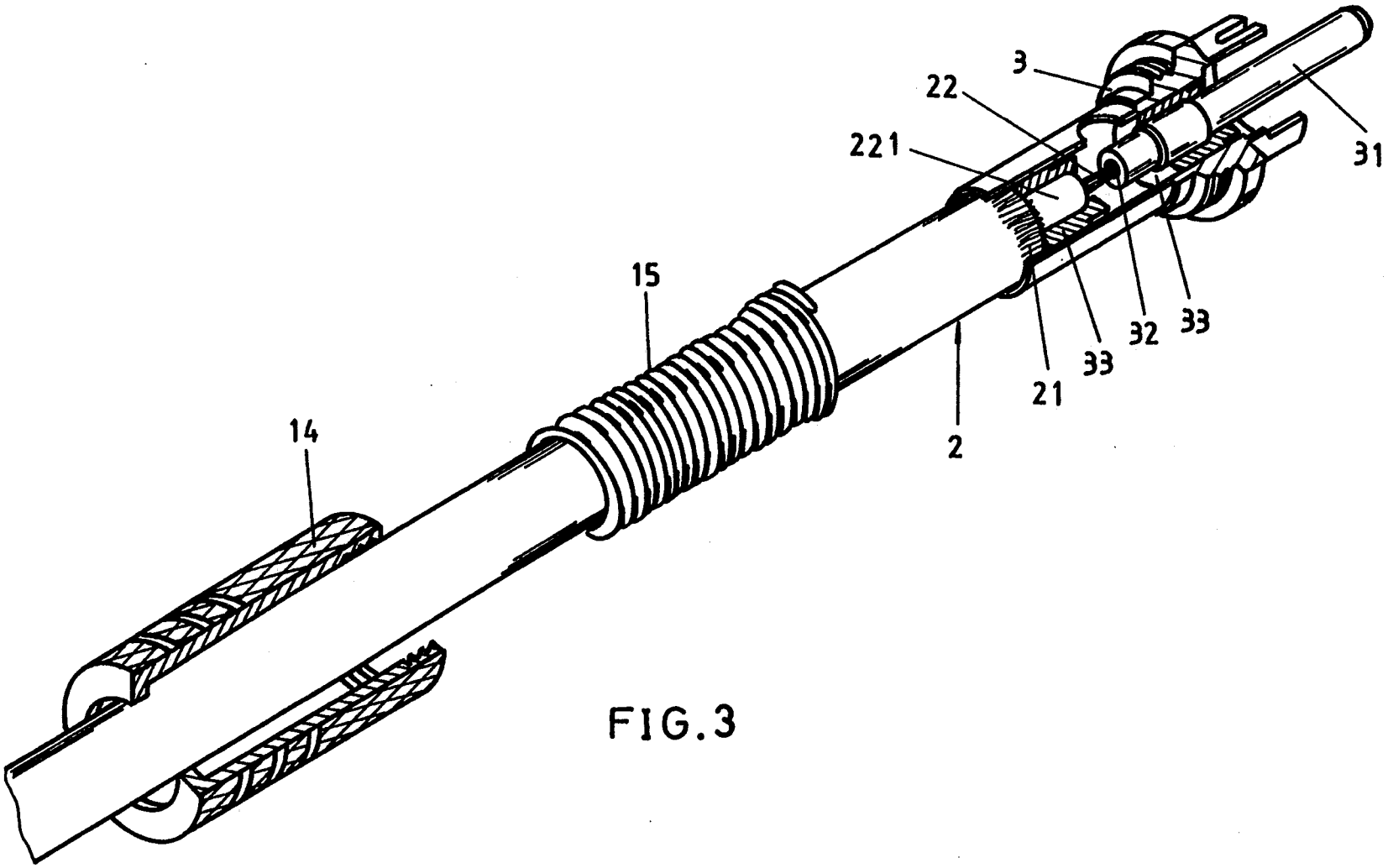

Referring to FIGS. 3, 5, and 6, a VCR terminal connector in accordance with the present invention is generally comprised of a metal contact casing 3 covered within a shell 14 and connected to the outside conductor 21 of a coaxial cable 2, a coil spring 15 retained between the metal contact casing 3 and the shell 14, a metal contact center rod 31 retained inside the metal contact casing 3 by two insulator bushings 33 and connected to the central conductor 22 of the coaxial cable 2.

The detailed structure and assembly process of the VCR terminal connector is outlined hereinafter with reference to FIGS. 4, 4A, and 4B, and FIGS. 3 and 5 again. The metal contact casing 3 comprises an axial through hole 35 through the central axis thereof, and a side hole 34 communicated with the axial through hole 35 at right angles. The metal contact center rod 31 comprises a hole 32 on the rear end thereof. As the central conductor 22 of the coaxial cable 2 is inserted into the hole 32 on the metal contact center rod 31, the rear end of the metal contact center rod 31 is punched by a hydraulic press and formed into a flat configuration, and therefore the metal contact center rod 31 is firmly retained to the central conductor 22 of the coaxial cable 2. The insulator bushings 33 are fastened in the axial through hole 35 of the metal contact casing 3 around the metal contact center rod 31 and the insulating medium 221 of the coaxial cable 2. The outside conductor 21 of the coaxial cable 2 is firmly retained between the inside wall of the metal contact casing 3 and the outside wall of the respective insulator bushing 33, and therefore the metal contact casing 3 is connected to the outside conductor 21 of the coaxial cable 2. As the coaxial cable 2 is inserted into the axial through hole 35 of the metal contact casing 3, the metal contact casing 3 is punched into a polygonal configuration to let the coaxial cable 2 be firmly retained to the metal contact casing 3. When connected, the coaxial cable 2 and the metal contact casing 3 (with the metal contact center rod 31 and the insulator bushings 33 on the inside) are put in a mold 4, then a liquid insulating compound 5 is filled into the mold 4 through a filling hole 41 thereon. As the liquid insulating compound 5 is filled into the mold 4, it covers the metal contact casing 3 and also penetrates through the side hole 34 on the metal contact casing 3 to fill up all gaps. As the insulating compound 5 is hardened, it forms into a layer of shield covered over the metal contact casing 3, the metal contact center rod 31, the insulator bushings 33, and the coaxial cable 2 to hold them tightly together.

Then, the coil spring 15 and the shell 14 are respectively fastened to the coaxial cable 2 and the layer of shield 5.

What is claimed is:

1. A VCR terminal connector comprising a metal contact casing connected to an outside conductor of a coaxial cable, a shell covered around said metal contact casing, a coil spring retained to said shell around the coaxial cable, a metal contact center rod retained inside said metal contact casing by insulator bushings and connected to the central conductor of the coaxial cable, wherein said metal contact center rod has a hole on a rear end thereof into which the central conductor of the coaxial cable is inserted and then retained thereto by deforming the rear end of said metal contact center rod through a punching process; said metal contact casing comprises an axial through hole, which receives said metal contact center rod and said coaxial cable, and a side through hole, through which a liquid insulating compound is filled into the axial through hole of said metal contact casing and hardened to form a layer of insulating shield covered over said metal contact center rod and the central conductor of the coaxial cable; said metal contact casing is deformed by punching, after the insertion of the coaxial cable and said metal contact center rod into the axial through hole of said metal contact casing, to let the coaxial cable be firmly retained thereto; insulator bushings are fastened inside the axial through hole of said metal contact casing around said metal contact center hole and the coaxial cable to firmly retain the outside conductor of the coaxial cable to said metal contact casing on an interior thereof; an insulating layer of shield is formed through an injection molding process and covered over said metal contact casing and the central conductor and outside conductor of the coaxial cable and filled up the gaps between said metal contact center rod and said metal contact casing.

* * * * *